United States Patent [19]

Östbo

[11] Patent Number: 4,698,016

[45] Date of Patent: Oct. 6, 1987

[54] GAS TURBULATOR

[76] Inventor: Nils Östbo, Södra Vägen 24, Göteborg, Sweden, 412 54

[21] Appl. No.: 829,130

[22] PCT Filed: Apr. 15, 1985

[86] PCT No.: PCT/SE85/00173

§ 371 Date: Dec. 10, 1985

§ 102(e) Date: Dec. 10, 1985

[87] PCT Pub. No.: WO85/04947

PCT Pub. Date: Nov. 7, 1985

[30] Foreign Application Priority Data

Apr. 17, 1984 [SE] Sweden ..... 8402133

[51] Int. Cl.[4] ..... F23M 9/06

[52] U.S. Cl. ..... 431/171; 138/38; 138/42; 431/354; 239/463; 239/472

[58] Field of Search ..... 110/326; 138/38, 42, 138/45; 239/463, 472; 431/158, 171, 354, 157, 347, 348

[56] References Cited

U.S. PATENT DOCUMENTS

| | | | |
|---|---|---|---|
| 2,287,361 | 6/1942 | Suchland | 110/326 X |
| 3,664,804 | 5/1972 | Flournoy et al. | 431/183 |
| 4,110,064 | 8/1978 | Vorona et al. | 431/171 |

FOREIGN PATENT DOCUMENTS

| | | | |
|---|---|---|---|
| 207126 | 2/1909 | Fed. Rep. of Germany | 138/38 |
| 861638 | 2/1941 | France | 431/158 |

*Primary Examiner*—Samuel Scott
*Assistant Examiner*—Allen J. Flanigan
*Attorney, Agent, or Firm*—Holman & Stern

[57] ABSTRACT

A gas turbulator (21) is used in burners (20) of different kinds to obtain better combustion. The turbulator is placed in a chamber or passageway (10) for hot combustion gases. The turbulator fills the passageway forcing the gases to pass a double-wall it including a first membrane wall (22) with radial slits (24) and another membrane wall (23) with a central exhaust opening (26). The slits (24) have oblique wings (25) at least along one edge, which causes the gases to mix intensively within the space between the membrane walls (22,23). These are, during burning, maintained at a high temperature, which guarantees an efficient final combustion.

5 Claims, 5 Drawing Figures

FIG. 1
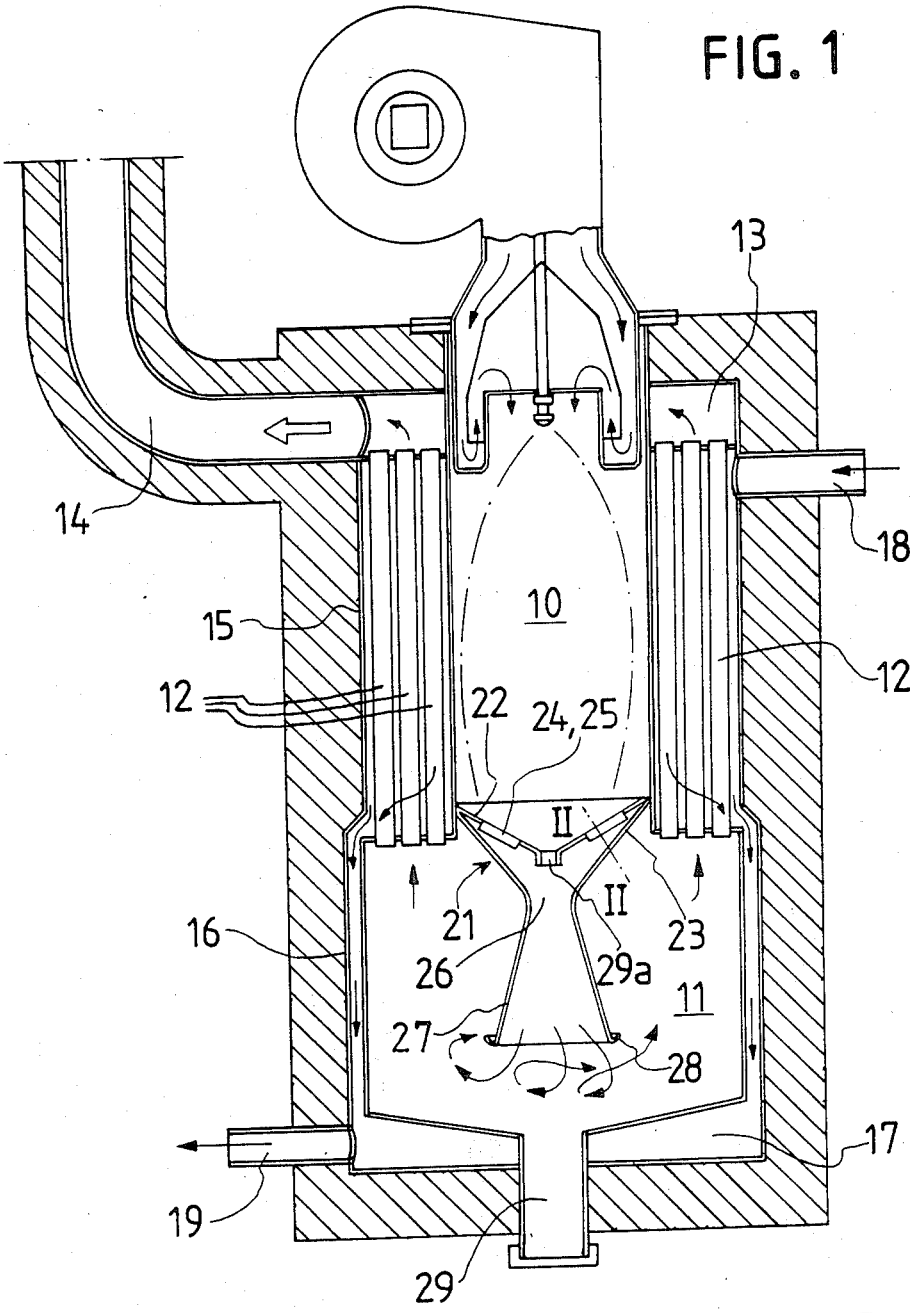
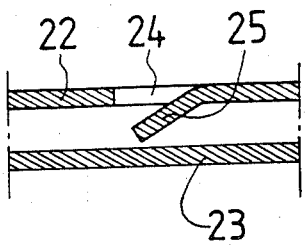
FIG. 2

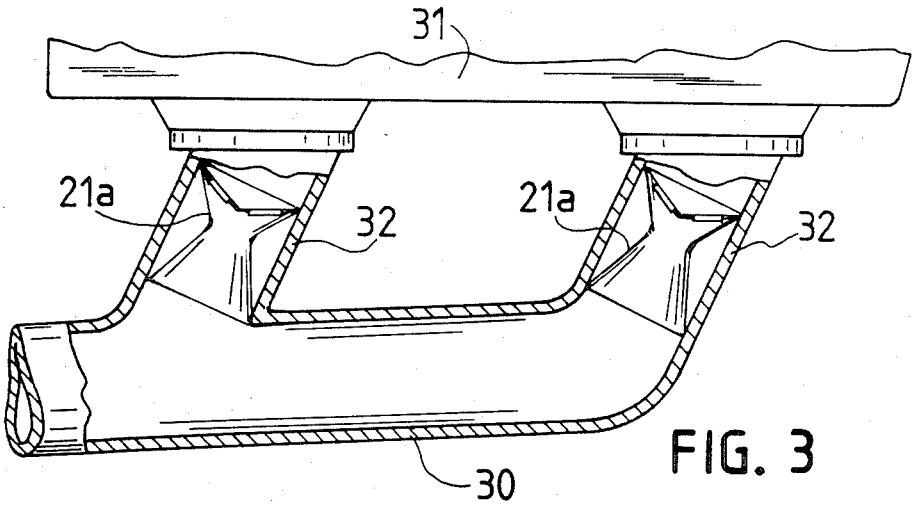
FIG. 3
FIG. 4
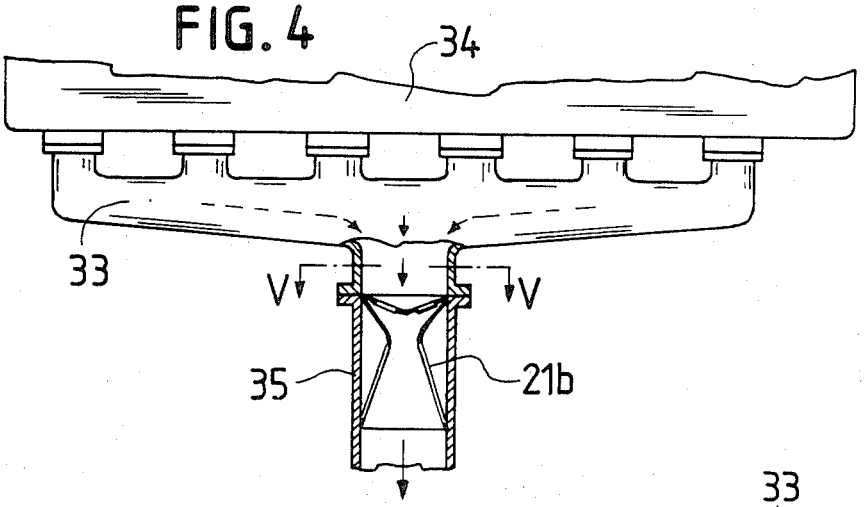
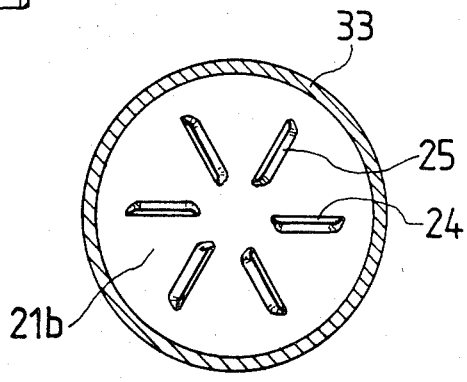
FIG. 5

GAS TURBULATOR

CROSS REFERENCE TO RELATED APPLICATION(S)

This U.S. application stems from PCT International Application No. PCT/SE85/00173 filed Apr. 25, 1985.

Old experience shows that combustion will be more complete if the gases are rotated to mix different parts of the gas flow. This mixing preferably takes place near a high temperature part of the route of the combustion gases.

The aim of the present invention is to propose a gas turbulator for different kinds of combustion devices, and which has a considerable effect in promoting an efficient final combustion of the gases, thereby increasing the thermal efficiency. The invention can be used on combustion devices in boilers for direct heat exchange, but can also be used in plants for destruction of pollution gases, e.g. exhausts from combustion engines or certain industrial processes.

The turbulator can be designed so the entire gas flow is compelled to pass through it, and it is characterized by a double-walled unit completely filling the outlet from said chamber and wherein a first membrane wall meeting the stream of gas has radial slits, each having an oblique wing along at least one edge, a second membrane wall having a central opening but otherwise having no disruptures, and an expansion outlet connected to said opening. The expression passageway includes any suitable part of a passage or a conduit.

The expansion nozzle preferably is formed as an expansion outlet and its outlet edge is preferably rounded.

At a turbulator adapted to a combustion device including a final combustion chamber with water cooled walls, the nozzle reaches substantially towards a cooled end wall in the final combustion chamber.

The first membrane wall can have a centrally located inspection opening.

The invention will now be described by way of example with reference to the accompanying drawings, in which FIG. 1 is a vertical section through a hot water boiler, FIG. 2 on a larger scale shows a section along line II—II in FIG. 1, FIG. 3 shows part of the exhaust manifold of an internal combusion engine having turbulators fitted in the outlets from the individual cylinders, FIG. 4 shows an exhaust manifold having a single turbulator in the common exhaust connection, and FIG. 5 shows a section along line V—V in FIG. 4.

The hot water boiler in FIG. 1 is of a basically well known type and includes a vertical combustion chamber 10 and a final combustion chamber 11 connected thereto. A number of smoke tubes 12 reaches up from this later chamber 11 to an upper collector 13, which is connected to an exhaust conduit 14.

The smoke tubes 12 pass through a water filled drum 15, which is connected to a water cooled wall 16 and bottom 17, respectively, defining the final combustion chamber 11.

The boiler supposedly is connected to a circulation system, from which water returns via a conduit 18, and to which water is fed via another conduit 19.

In the upper part of the combustion chamber there is provided a conventional oil or gas burner 20. The burner can be arranged to give the combustion gases some rotation already within the combustion chamber 10.

In the lower end of the combustion chamber a turbulator 21 made of heat resistant steel is provided, and is so formed, that it completely fills the cross sectional area of the combustion chamber.

The turbulator comprises a double-walled upper part having an upper membrane wall 22, and a lower membrane wall 23. The upper membrane wall has several radial slits 24. Each of these have an oblique downwardly projecting wing 25, along one of its edges, shown on a larger scale in FIG. 2.

The lower membrane wall 23 is mainly undisrupted, but has a central gas exhaust opening 26. An expansion nozzle 27 is connected to this opening and has a rounded outlet edge 28.

The nozzle preferably is formed as an expansion nozzle, wherein some of the velocity increase in the opening 26 is converted into pressure.

In the example shown in the drawings the nozzle 27 reaches down towards the cooled bottom 17. The gases are rapidly cooled there, which decreases the Nitrogen-Oxide contents in the exhaust gases.

The bottom has an inspection opening 29 and there is a central opening **29*a* in the upper membrane wall 22, through which opening it is possible to observe the flame via the inspection opening 29, during operation. The opening 30 is substantially smaller than the opening 26**, and especially if the gases are rotated already within the combustion chamber, there will be no noticeable axial emission of gas.

During burning the turbulator will be heated to a high temperature, and all exhaust gases must pass through the space between the two membrane walls 22 and 23. Here an intimate mixing of the gases take place, and an efficient final combustion occurs during the passage through the nozzle 27 and in the chamber 11.

A wing 25 is arranged along one of the edges of each slit 24, and is directed down towards the other membrane wall. Alternatively, or additionally, the opposite edges of the slits can have an upwards oblique wing.

The boiler is shown and described standing vertically, but can also be horizontally arranged. The burner can be modified for burning of wood or coal powder, coal slurry or other fuels with partially pulverized consistency.

An important use for the invention is for destruction of gases from different processes, e.g. within the cellulose pulp industry, where gases should not be emitted freely into the atmosphere. In many cases these gases contain combustible components, but through addition of supplementary fuel sufficient temperature can be attained to burn odorants, or break down, e.g. solvents.

The gas turbulator herein described can advantageously be mounted within the exhaust manifold of an internal combustion engine. It will contribute to an efficient final burning of the emissions in the gas, and will also absorb exhaust noice.

Naturally it is not necessary for the turbulator to have the same diameter as the combustion chamber or passageway. In a very large combustion chamber it is possible to lay bricks to form a constriction of the cross section, in which the turbulator can be mounted.

FIG. 3 shows part of the exhaust manifold 30 of an internal combustion engine 31. In the exhaust duct 32 from each cylinder a gas turbulator **21*a*** is fitted.

In the embodiment according to FIG. 4 the exhaust manifold 33 is connected to the six cylinders of the internal combustion engine 34, and a single gas turbulator 21*b* is fitted in the common exhaust connecting pipe 35.

The turbulator can be retained in any suitable manner, for instance as in FIG. 3, where its top part rests against shoulders in the exhaust duct, possibly locked by some bayonet fitting. In FIG. 4 lips at the top part are clamped between the flange of the exhaust duct and the mating flange of the exhaust connecting pipe.

FIG. 5 shows a view of the top part of the turbulator, as viewed from the inlet side. The radial slots 24 and the tongues therein will impart a decisive swirling motion to the gases.

What is claimed is:

1. Turbulator means located in a passageway from a source of hot gases and comprising:

a member having an upper part including first and second, spaced-apart membrane walls forming between themselves a gas mixing space, and fitted to completely fill said passageway;

said first membrane wall meeting the stream of gases being provided with radial slits each having an oblique wing along at least one of its edges;

said second membrane wall having a central opening, but otherwise having no disruptures; and an expansion nozzle connected to said opening.

2. A turbulator means according to claim 1 in which said nozzle has a rounded outlet edge.

3. A turbulator means according to claim 1 used in a furnace having a final combustion chamber with water cooled walls, in which said expansion nozzle reaches a substantial length towards a cooled end wall in the final combustion chamber.

4. A turbulator means according to claim 1 in which said first membrane wall has a centrally placed inspection opening.

5. A furnace of the kind comprising:

a combustion chamber surrounded by a number of smoke-tubes and connected to a final combustion chamber defined by water-cooled envelope and end walls;

a burner at one end of said combustion chamber and a turbulator means at the opposite end of said combustion chamber; said turbulator means comprising:

turbulator means located in a passageway from a source of hot gases and comprising:

a member having an upper part including first and second, spaced-apart membrane walls forming between themselves a gas mixing space, and fitted to completely fill said passageway, said first membrane wall meeting the stream of gases being provided with radial slits each having an oblique wing along at least one of its edges, said second membrane wall having a central opening, but otherwise having no disruptures, and an expansion nozzle connected to said opening and reaching a substantial length towards said water-cooled end wall of the final combustion chamber.

* * * * *